United States Patent [19]

Montagner

[11] 4,223,609

[45] Sep. 23, 1980

[54] METHOD AND INSTALLATION FOR LOADING PASSENGERS ON A MOBILE SUSPENDED CARRIER

[75] Inventor: René Montagner, Allonzier La Caille, F-74350 Cruseilles, France

[73] Assignee: René Montagner nee Ailloud, Cruseilles, France

[21] Appl. No.: 908,867

[22] Filed: May 23, 1978

[30] Foreign Application Priority Data

Jun. 2, 1977 [FR] France ..... 77 16909
Feb. 10, 1978 [FR] France ..... 78 03886

[51] Int. Cl.[2] ..... B61K 1/00

[52] U.S. Cl. ..... 104/20; 104/135; 104/162; 104/165; 104/168; 104/173 ST; 198/324

[58] Field of Search ..... 104/18, 20, 162, 165, 104/168, 173 R, 173 ST, 178, 135; 198/324, 323

[56] References Cited

U.S. PATENT DOCUMENTS

| | | | |
|---|---|---|---|
| 2,905,100 | 9/1959 | Kendall et al. | 104/20 X |
| 3,052,337 | 9/1962 | Force, Sr. | 198/323 |
| 3,339,496 | 9/1967 | Sneller | 104/173 ST |
| 3,548,753 | 12/1970 | Thurston | 104/173 ST |
| 3,602,361 | 8/1971 | Cheronis | 104/173 ST |
| 3,896,738 | 7/1975 | Dubeta et al. | 104/173 ST |
| 3,981,248 | 9/1976 | Savage | 104/173 ST |

FOREIGN PATENT DOCUMENTS

| | | | |
|---|---|---|---|
| 2033617 | 1/1971 | Fed. Rep. of Germany | 104/173 ST |
| 1451552 | 7/1966 | France | 104/173 ST |
| 2236707 | 2/1975 | France | 104/173 ST |
| 196857 | 7/1938 | Switzerland | 104/173 ST |
| 255331 | 1/1949 | Switzerland . | |

*Primary Examiner*—Randolph A. Reese
*Attorney, Agent, or Firm*—Griffin, Branigan & Butler

[57] ABSTRACT

A passenger loading method and installation is provided by means of which passengers are mechanically propelled and accelerated to a velocity substantially the same as that of a main transport structure onto which they can be loaded without the necessity of stopping or slowing movement of the main transport structure. The invention is particularly applicable to ski-lifts and enables an increase in hourly carrying capacity of such lifts.

27 Claims, 4 Drawing Figures

METHOD AND INSTALLATION FOR LOADING PASSENGERS ON A MOBILE SUSPENDED CARRIER

BACKGROUND OF THE INVENTION

The present invention concerns a method and installation for loading passengers, particularly skiers, on a mobile suspended carrier of the ski-lift or chair-lift type.

The considerable development of tourism in the mountains and of winter sports has brought an increase in the number of mechanical lifts, especially of the ski-tow type. Among the various types of mechanical lifts, chair-lifts and ski-tows are the most common at present. Such mechanical lifts generally include a single cable, running at practically constant speed and carrying structures to allow traction or transportation of passengers, such structures being held on the cable by means of fixed or declutchable clamps. On ski-tows, the passenger is pulled by a perch (single place ski-tow) or a bow in the shape of a T with both branches upside-down (double place ski-tow). On chair-lifts, the passenger is carried by a structure dimensioned and built to provide a bench with seating for one or several passengers, the most frequently seen types having two and three places.

A problem common to all these types of mechanical lifts resides in the loading of passengers at the time of departure when the passenger, initially motionless must at the end of the starting phase, be brought to more or less the same speed as that of the cable, which is generally on the order of several meters per second.

Several methods have been proposed to facilitate loading of passengers on mechanical lifts. Thus, in ski-tows with automatic departure, the departure zone is in the form of an inclined plane having a downward slope on which the passenger accelerates, through gravitation, then seizes a pole which is fixed on the cable so that, if the skier and the cable have more or less the same speed, the departure takes place satisfactorily. For chair-lifts with a declutchable clamp, passengers sit on a bench which proceeds slowly, gradually accelerates under the effect of a suitable drive means and then is fixed on the cable in order to transport the passenger at the speed of the cable itself. Finally, in chair-lifts utilizing a fixed clamp, no special solution is envisaged at present so that the speed of the cable must be limited to avoid too important shocks at the instant of embarking.

Apparatus using these various methods presents several disadvantages. Thus, for ski-tows with automatic departure, snow conditions and the skier's capabilities may cause poor speed matching at the time of departure. It is therefore necessary that acceleration ramp be adequately covered with snow or ice. The chair-lift with a declutchable clamp is much more expensive than a chair-lift with a fixed clamp and requires careful maintenance. Chair-lifts with fixed clamps are slower and thus allow only a limited flow of passengers.

The object of the present invention is to obviate these various disadvantages by a method and installation for loading passengers allowing a substantial improvement in the comfort and safety of the loading and at the same time an increase in the speed and thus capacity of mechanical lifts of the fixed clamp type, with overall costs being considerably lower than those of a chair-lift of the declutchable type.

SUMMARY OF THE INVENTION

The new loading method reduces the relative velocity between passenger and lift at the time of embarking, independently of the velocity of the lift.

To achieve this, such method includes propelling the passenger in the same direction as the lift movement to approach optimal departure conditions with a small difference in velocity between the passenger and the lift.

Most mechanical lifts have the disadvantage at the loading zone of being adapted to a standard size of passenger, which may create problems in the loading of small persons, children in particular.

The present invention provides a loading method taking advantage of the passenger's motion to vary the vertical distance between the seat level and the starting area independently of the specific structure of the mechanical lift. Thus, the advance of the propelled passenger is effected on a slope having a variable inclination adjustable according to the size of the passenger.

The loading installation includes a pusher element capable of displacement more or less in a plane, control means to drive the pusher element at variable and progressive speed, order indicating means for the benefit of users and means to adjust the inclination of the starting slope.

To make the installation independent of weather conditions, the departure ramp includes a track covered with synthetic material or with rollers.

Since the propelling distance of the pusher element is necessarily limited as well as the passenger's launching speed when the pusher disappears, even by multiplying the pusher elements on a single driving structure, the loading rate quickly reaches a functional limit beyond which the loading procedure would be effected in reduced safety conditions.

To increase the loading rate the passengers may be propelled by additional launching means, to effect further velocity increase, then liberated just prior to their embarkment.

The method and installation further allow simultaneous loading of at least two passengers on a carrier, whatever the length of their skis.

Thus, the installation includes a departure zone with a support surface having a low coefficient of slip, followed by a series of driven rollers moving at their support peripheries in the direction of motion of the passengers, such rollers being all driven at the same speed, means being provided to vary the rotation speed of these rollers, and propulsion of the pusher element extending over at least part of the starting area and over part of the roller track.

With such an installation, skiers in lines of two or three are rapidly and automatically positioned on the starting area by the pusher element regardless of their alignment at their arrival.

DETAILED DESCRIPTION

Figure 1:
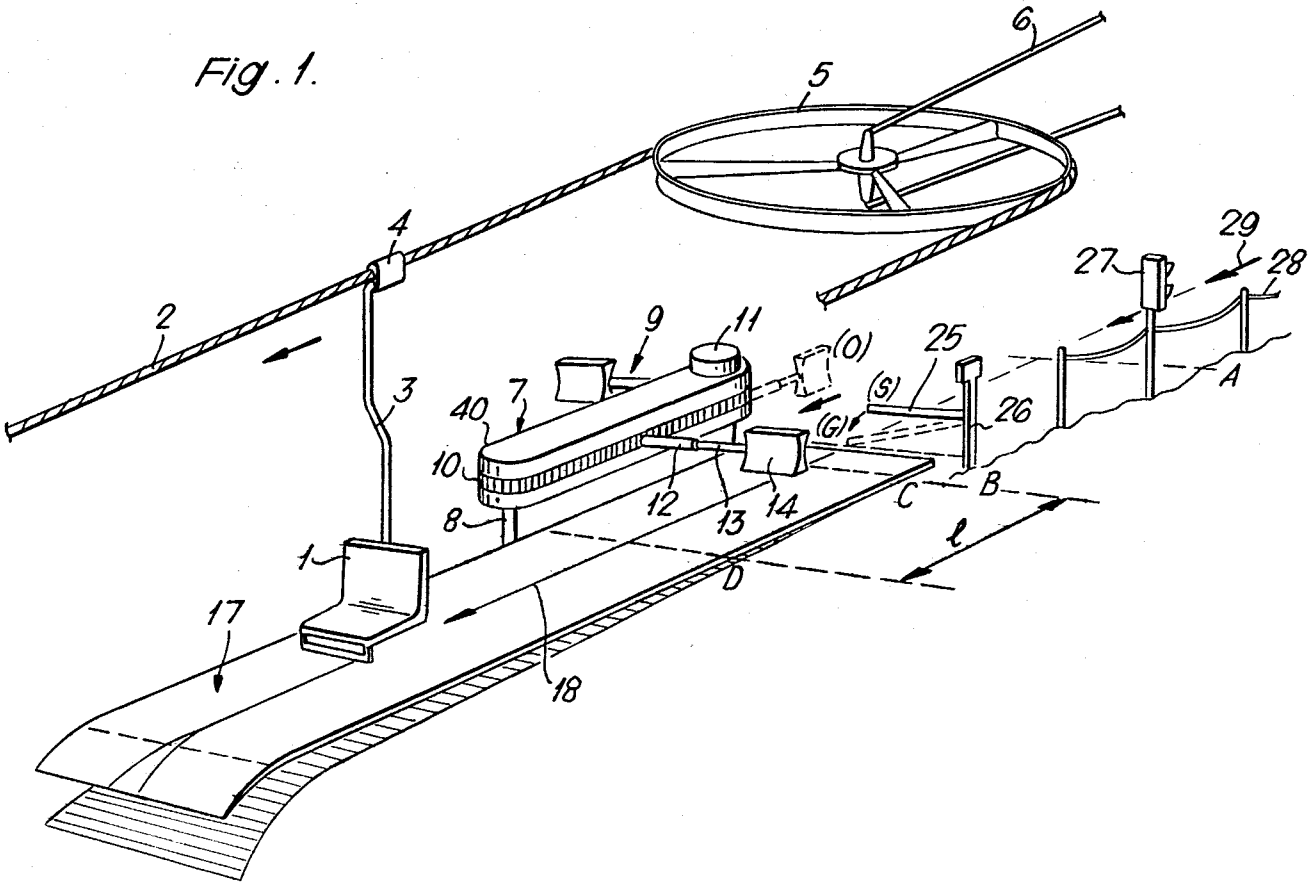
FIG. 1 is a schematic perspective view of the installation according to the present invention.

FIG. 1 represents schematically a loading zone for a chair-lift equipped with an installation according to the invention. The chair-lift as represented is of the fixed clamp type and is built traditionally of a procession of benches, generally referenced 1 and of which one only is represented, swingably mounted on a traction cable 2 by means of suspension 3, the upper extremity of which is fixed to cable 2 by a clamp 4. In an equally known fashion, the lift reverses direction above the loading area, cable 2 being supported by a return pulley 5 suspended as is well known by arms or shrouds 6 to a fixed structure or pylon (not shown).

Figure 2:
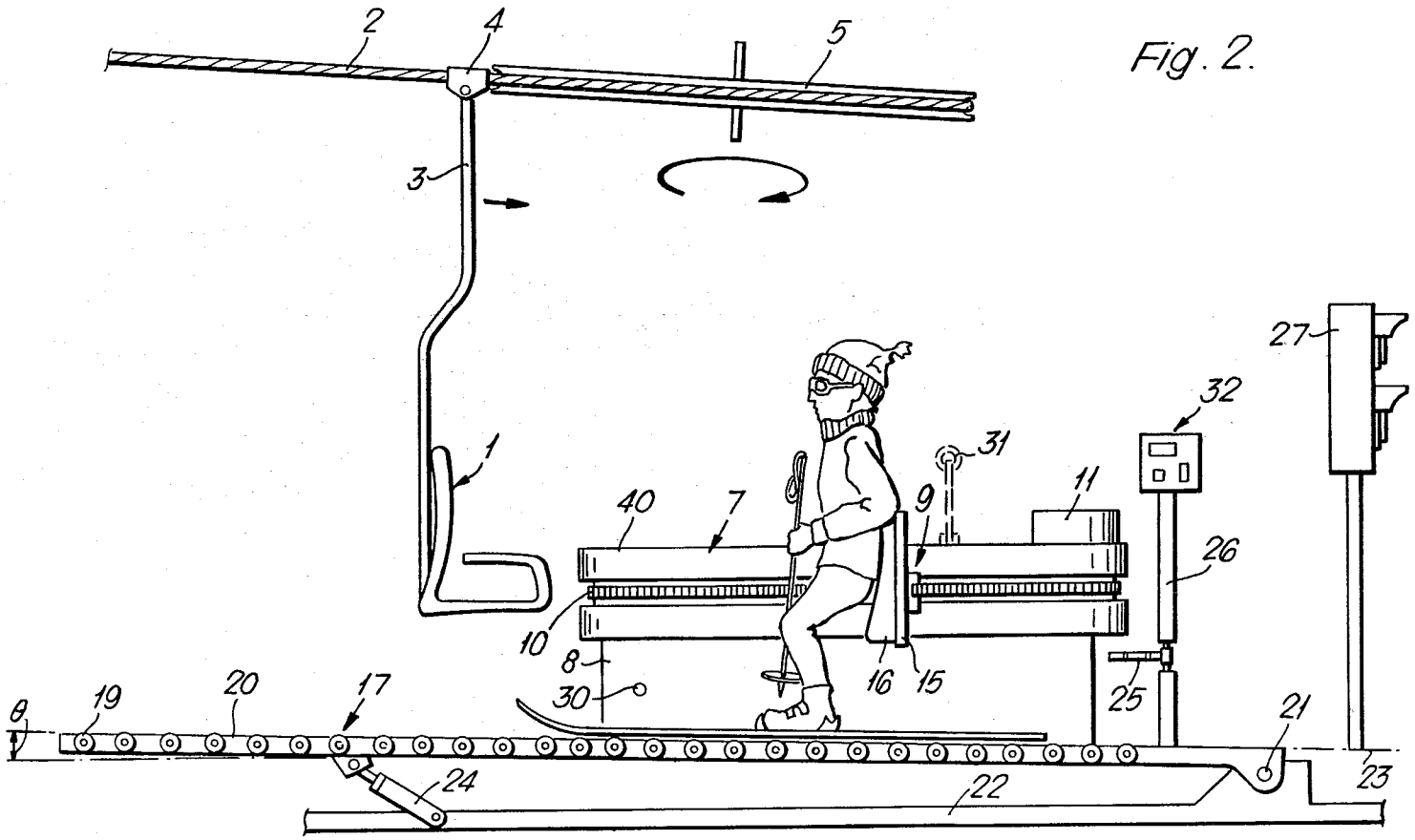
FIG. 2 represents a side view of the installation as in FIG. 1 with a partial section of the launching track.

The loading installation includes essentially a propelling apparatus, generally referenced 7, made of a fixed support 8, anchored in the ground and of at least one pusher element, generally referenced 9, fixed to an endless driving means, for example a chain 10, mounted on support 8 within a gear-case and driven by motor 11 so as to make element 9 describe a closed trajectory in an approximately horizontal plane, which trajectory includes a linear portion over distance l and is situated above loading track 17, track 17 being beneath the displacement area of carrying structures 1 which have just left pulley 5. Element 9 includes a support arm 12 and telescopic arm 13 capable of retracting within arm 12. The outer end of arm 13 is provided with a pushing surface 14 preferably made of a plane rigid plate 15 having cushioning 16, e.g. synthetic foam (FIG. 2).

Median axis 18 of track 17 corresponds approximately to the projection of loaded cable element 2 on the ground. Loading and starting track 17 is made of a rigid structure presenting a supporting face of synthetic material, allowing adequate slip (FIG. 1) or, as represented in FIG. 2, of a plurality of rollers 19 mounted to pivot freely on a châssis 20. In both cases, track 17 is installed so as to pivot around horizontal axis 21, borne by support structure 22 preferably buried. In this way, track 17 can be lifted to form an angle $\theta$ relative to the horizontal plane represented by dash-dot line 23 on FIG. 2, for example by means of an hydraulic or pneumatic jack 24 mounted so that its lower extremity pivots on supporting structure 22.

The installation further includes proximate pivoting axis 21 of track 17, a removable stop arm 25 mounted so as to rotate in a horizontal plane on pole 26 erected laterally outside track 17, so that arm 25 may extend across the entrance of the track to constitute a barrier. The installation further includes, above arm 25, a signalling apparatus 27 preferably in the form of red and green lights to be used as described hereinafter.

The installation functions as follows: the queue of passengers is channeled towards the entrance of the installation by traditional means, such as ropes 28 drawn between stakes. The movement of a passenger is indicated by arrow 29 on FIG. 1. Signalling apparatus 27 is red, indicating that the passenger must wait at station A for his turn to move forward. After signal 27 has turned green, the passenger proceeds to station B where arm 25, in its blocking position indicated in full lines and referenced S on FIG. 1, stops him until the preceding passenger has embarked. After such embarkment has taken place, pusher element 9 comes to its wait position, indicated in dots on FIG. 1 and reference O, in synchronism with the arrival of the following seat 1. Arm 25 is removed to the position indicated in dots on FIG. 1 and reference G, allowing the passenger to proceed to position C, where surface 14 of pusher element 9 comes gently into contact with his lumber zone, then accelerates rapidly to bring him to position D, where arm 13 is telescoped and thus releases him with his acquired speed. The passenger is immediately caught by the seat on which he can embark, the relative speed of the seat to the passenger being limited to less than one meter per second. During this time, the next passenger has followed the same progression step by step and the process is repeated.

The motion of pusher element 9 is continually accelerated between wait position O and a position preceding release zone D, following which it is continually decelerated to return to wait position O or another wait position on apparatus 7 should there be several pusher elements. Signal lights 27 are operated on one hand by the motion of arm 25 and on the other hand by detecting apparatus 30 placed near position D and serving at the same time to stop the mechanism should a passenger fall. The motions of pusher element 9 and stopping arm 25 are synchronized with the motion of seats 1 round pulley 5, e.g. by means of a photo-electric cell detecting system 31 detecting the passage of seat 1 around pulley 5. Arm 25 is removed to its position G when the preceding passenger has passed in front of cell 30, and pusher element 9 leaves its wait position O when cell 31 has detected the arrival of the empty seat on which the passenger is to embark.

Support 26 is further provided with recording and controlling means 32 to count passengers, to control the installation manually in sequential functioning, and to operate jack 24 to modify angle $\theta$ of ramp 17 in case small passengers are present in the queue above station A.

For utilization in summer time, boards can be provided to serve as support for passengers, thus allowing them to be propelled in the same manner as skiers wearing skis. On the other hand, synchronization between the motions of the pusher elements and the arrival of the seats can be realized by mechanical sensors or by a centralized common control apparatus for the whole installation.

Figure 3:
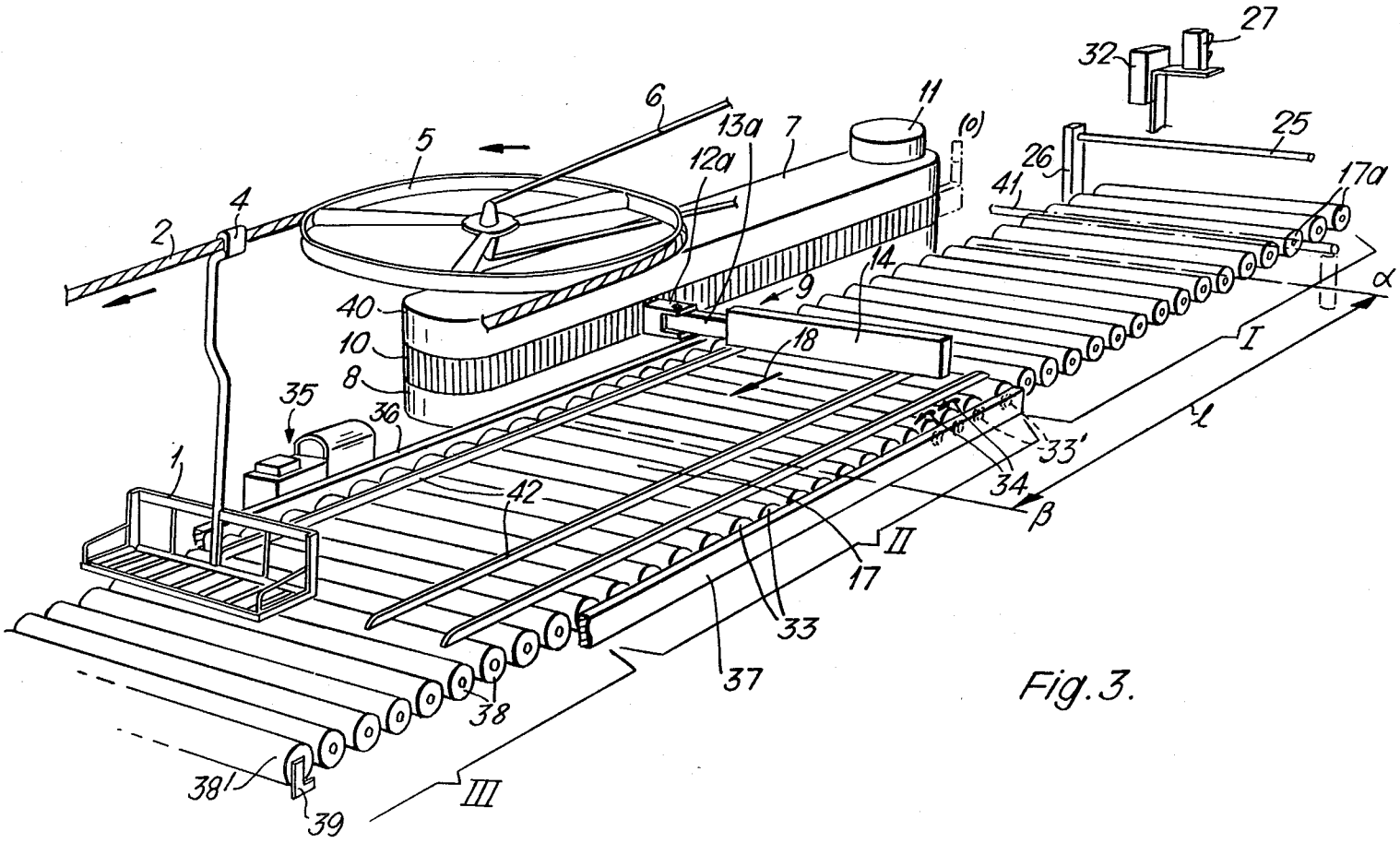
FIG. 3 represents a schematic perspective view of a loading installation with improved performances over the proceding one.

The installation as represented in FIG. 3 may improve substantially the loading capacity, increasing at the same time comfort and safety conditions. The elements corresponding to those of the previous example bear the same reference numbers.

A hanging bench 1 has been shown in this example. It is designed to accommodate several passengers with a maximum of six. The invention is however still applicable to single seats. Pusher element 9 includes, in this version as shown, a support arm **13*a* articulated on a vertical rotation axis on a head 12*a* fixed to chain 10. Surface 14 fixed to the support arm 13*a* has a length corresponding to the maximum number of passengers to be loaded together. This will be the same as the width of the loading track 17. This track 17 includes a first zone I or parting zone comprising natural snow, or a synthetic coating of low slip or preferably a series of parallel rollers 17*a* spinning on their two ends in a support châssis (not shown) approximately parallel to the surrounding ground surface as in the preceding example. This departure zone I is elongated in the forward direction indicated by arrow 18 by a pushing or passenger launching zone II including a series of rollers 33 all driven in rotation at the same speed in the sense of arrows 34 by an electric motor having variable drive speed control and incorporating for example for easy maintenance an induction motor with a forced switching converter or a self-controlled synchronous motor with a wave rectifier. Rollers 33 are driven in rotation by gear or belt means arranged in a casing 36 extending along track 17 and are mounted so as to rotate in a rigid châssis 37 having a variable inclination, the initial rollers at least being driven through uni-directional clutches 33', for example of the free wheel type permitting them to rotate more rapidly in the sense of arrows 34 through the action of an exterior driving force than the driving speed transmitted by the motor reducer 35** for reasons which will be explained subsequently.

Zone II with driven rollers may be advantageously elongated by a low slip zone III formed for example by a series of parallel rollers 38 loosely mounted in a chassis which may also be of variable inclination (not shown). The loading installation is arranged proximate the loading zone for the carrying structures 1 in a manner such that the useful course or propelling course l of the pushing element 9 extends over at least the final portion of the first zone I and onto the beginning portion of the driving zone II, the plane where the urging of the pusher element 9 ceases being advantageously situated slightly ahead of the pulley 5 and the driving zone II being prolonged approximately to the proximity of the free arc of pulley 5 between the two portions of cable 2.

The correct sequential placing of the passengers on the departure zone I is brought about as in the preceding example, with the exception that several passengers may be placed in a row. Pusher element 9 having acted during the loading of the preceding passengers is rapidly returned towards the waiting position O shown in dashed lines on FIG. 3 in synchronism with the arrival of the following seat 1. When arm 25 is removed it permits the passengers to advance approximately aligned onto departure zone I of track 17 upto the position indicated by $\alpha$ where surface 14 of pusher element 9 comes lightly in contact with their lumbar zone thus bringing about their perfect alignment, then rapidly accelerates them along the path l to bring them continuing in alignment onto zone II. At this precise moment rollers 33 turn at a speed below the propulsion speed attained by the passengers under the influence of pusher element 9, the clutch mechanisms enabling a skidding of the rollers until the passengers arrive at position $\beta$ where element 9 is removed by rotation around the pivoting axis connecting arm 13*a* to head 12*a*, rollers 33 having in the meantime been progressively accelerated to reach a peripheral speed above the speed of propulsion of the passengers as produced by the pusher element 9. Between position $\beta$ and the end of zone II the peripheral speed of rollers 33 continues to increase in a continuous manner to bring the passengers to a maximum speed on zone III, this maximum speed being controlled to correspond to the speed of the carrying structures 1, the loading of passengers being effected over a predetermined area of zone III. The cycle is continued thereafter in a similar manner.

At least one of the final rollers 38' of zone III is rotatingly mounted in slots on its châssis and urged upwardly by a spring so as to cooperate with an associated detection arrangement 39 in a manner such that in case of failure to correctly load at least one passenger, the passenger will arrive at the lower extremity of zone III and operate by his weight the detecting arrangement 39 which brings about stopping of the launching arrangement and eventually of the chair-lift.

Figure 4:
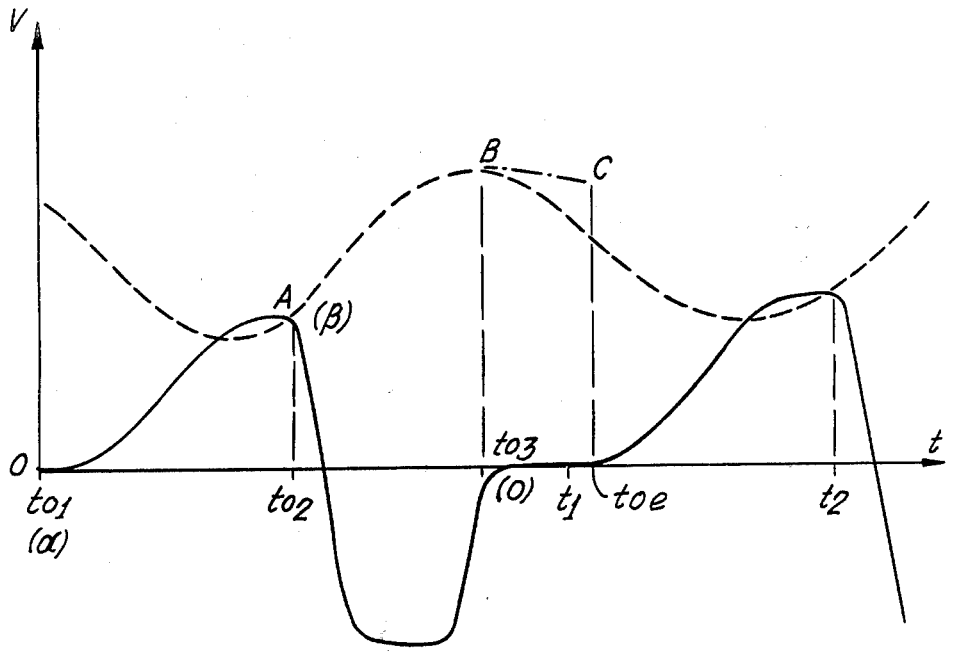
FIG. 4 is a graph of the relative speeds of two successive driving elements in the arrangement of FIG. 3.

In FIG. 4 is shown a graph of comparative speeds of the pusher element 9 (full line) and of the peripheral speed of rollers 33 in the driving zone II (dotted line). On this graph is represented two successive cycles of pushing of the pusher element 9 (positive portions of the curve in a continuous line) or two successive pushings of two pusher elements.

The moment $t_{o1}$ corresponds to the taking up of passengers in position $\alpha$ on departure zone 1 by the pusher element, the propelling course of this arm at continually increasing speed being represented by the portion OA. Thus pusher element 9 reaches its maximum speed of propelling of the passengers on the zone II of driven rollers at the instant $t_{o2}$ (position $\beta$) i.e. about at the moment when the peripheral speed of the rollers 33 reaches this value. Thereafter the speed of the arm decreases rapidly to become zero and again increases during the return course to bring the arm into the waiting position (O). The passengers now on the rollers 33 of zone II are progressively brought up to the maximum speed at the end of zone II. i.e. at the moment of release $t_{o3}$ according to portion AB of the curve, the speed of rollers 33 then decreasing rapidly to await the following loading cycle. The free speed of the passengers propelled by rollers 33 onto zone III is indicated by portion BC, the effective loading on the carrying arrangements being effected at the moment $t_{oe}$.

On this diagram it will be seen that taking up the following passengers, i.e. at the moment $t_1$, is effected approximately at the same moment when the preceding passengers are loaded on seats 1 at the instant $t_{oe}$. Thus there is practically no slack time owing to the return of arm 9, the combination of the two successive means of acceleration permitting an arrangement with a single arm and consequently an arrangement with several arms to eliminate the slack time resulting from the return to the initial position of pusher element 9. As may be seen on FIG. 2 the launching speed of the passengers is well above that permitted by a single pusher element 9, thus permitting the operation of the chair-lift installation at speeds better than 3 or 4 m per second.

As already mentioned the driving in rotation at speeds continually accelerated of all the driving rollers 33 enables maintenance of the passengers in an impeccable manner along a single line for their embarcation and this independent of the length of their skis.

The rotation sequences of the pusher elements 9 and the increase in speed of the driving rollers 33 are synchronized with one another with the passing of the carrying structures 1, detecting arrangements for the passage of the carrying structures being foreseen as in the case of FIG. 2 and a central command post 32 being foreseen for the overall installation.

According to a further variant the driven rollers 33 of zone II may be replaced by a moving belt or by a second propelling mechanism arranged on the other side of track 17 and of which the arms being displaced over a shorter distance will take over from the succession of elements of the first mechanism to bring the passengers to the maximum speed B on the free rollers 38 below the driving zone II. In the same manner again the several zones I, II and III of track 17 may be advantageously mounted on an articulated châssis of which the angle relative to the ground may be controlled by controllable jacks. One may equally foresee proximate position $\alpha$ a second removable stopping arrangement such as a pivotable bar 41 indicated in shadow outline on FIG. 3 or a gate, arranged to bring about a correct alignment of the passengers before pusher element 9 comes into contact with them, bar 41 being removed only when the passengers are taken up by pusher element 9. In this case the initial bar 25 could be eliminated. Finally, in order to avoid lateral slip of the passengers, particularly skiers, at the moment of acceleration, parallel guides 42 are provided at least in zone II and eventually over a portion of zone III in order to define guide passages for the skis. Such guides 42 may be formed of profiled members extending just above rollers 33, 38 and supported on vertical members installed between the rollers.

Wht is claimed is:

1. Method for loading passengers onto carrying elements of a moving suspended carrying structure through driving or propelling the passengers in the direction of movement of the carrying elements in order to achieve increased passenger loading speed with a low relative velocity between passengers and the carrying elements, said method including the steps of engaging said passengers above their feet with a pushing instrument, pushing said passengers at a variable speed to accelerate the speed of the passengers, and thereafter engaging the passengers with the moving suspended carrying structure.

2. Method according to claim 1 wherein the movement of the pushing instrument is synchronized with movement of the carrying elements on the suspended carrying structure.

3. Method according to claim 1 wherein passengers are propelled by said pushing instrument along a ramp of controllably variable inclination and wherein is further included the step of controlling the inclination of said ramp.

4. Method according to claim 1 wherein said passengers are pushed along a departure ramp, at least a portion of which has a low coefficient of friction, thereafter, further driving to accelerate the speed of said passengers from the terminal velocity attained through pushing whereby the passengers are advanced at a continually increasing velocity to a maximum determined so as to be slightly lower than the carrying structure velocity.

5. Method according to claim 4 wherein a portion of said ramp comprises rollers driven in rotation at a peripheral speed lower than that imparted by the pushing instrument and wherein a downstream portion of the ramp comprises rollers driven at a rotational speed being accelerated toward the end of propulsion by pushing to arrive at a speed equal to that of said pushing at the end of the pushing activity said rollers then being further accelerated to a maximum peripheral speed above the maximum propulsion velocity of the pushing following advancement of the passengers onto the rollers beyond a limit point of effective propulsion by said pushing.

6. Method according to claim 5 wherein the driving speed of the driven rollers increases and decreases continuously in a cyclic manner in synchronism with the pushing activity.

7. Method according to claim 6 wherein is further includes the step of synchronizing motion of the pushing movement with the procession of carrying elements on the carrying structures.

8. System for loading passengers onto carrying elements of a moving suspended carrying structure comprising a launching means for launching passengers capable of placing themselves in a plane approximately parallel to the plane of motion of the carrying structure and a controllable means for driving the launching means at variable speeds, said launching means including a pusher element means coupled to a driving device driven by a prime mover at a variable speed to engage the passengers above their feet and push the passengers in the direction of motion of the carrying-structure carrying elements on which they are to be loaded.

9. System according to claim 8 in which the passengers are skiers and the carrying-structure carrying element comprises an element of a ski lift.

10. System according to claim 9 in which the launching means includes a launching track on which skiers being launched stand, said launching track being provided with a synthetic floor material having a high slipping coefficient relative to the sole of a ski.

11. System according to claim 9 in which the launching means includes a skier support surface formed by an assembly of horizontal parallel rollers capable of spinning on axes supported in a rigid chassis.

12. System according to claim 9 wherein the pusher element means is arranged to be linearly displaced over a predetermined distance in a direction substantially the same as the direction of advance of the carrying structure at the loading zone, and wherein is further included a controllable means for driving said pusher element means in a cyclic manner at variable speeds, a departure zone having a support surface on which skiers being launched stand with a low slipping coefficient elongated in the sense of movement of the pusher element by a series of free parallel rollers, additional rollers, adjacent the final portion of said departure zone, being driven at a rotation speed variable in time, and means for controlling the driving speed of said rollers, the active pushing region of the pusher element means extending over at least the final portion of the departure zone and onto the beginning portion of said series of parallel driven rollers.

13. System according to claim 12 wherein the driven rollers are driven by an electric motor having a continuously variable speed control.

14. System according to claim 13 wherein at least the initial rollers in the series of driven rollers are driven through a unidirectional clutch mechanism permitting them to rotate under application of an exteriorly applied force at a peripheral speed above that of the motor driving speed and in the same sense as the motor drive.

15. System according to claim 12 wherein the series of driven rollers is extended by a series of free rollers in the direction of passenger advancement.

16. System according to claim 15 wherein at least one of the free rollers in the extended series is provided with detection means responsive to the weight of a passenger in order to stop the system, as well as driving means for the carrying structure in the event of failure to load at least one passenger.

17. System according to claim 12 including control means for the roller driving speed said control means having position detectors for the carrying structure.

18. System according to claim 12 wherein at least the driven rollers and the departure zone rollers are supported in a rigid chassis having a controllably variable inclination.

19. System according to claim 12 comprising a passenger selection zone preceding the departure zone and which includes signalling means and a removable gate therein synchronized with movement of the carrying structure.

20. System according to claim 12 in which at least the track formed by the series of driven rollers is provided with guide members extending parallel to the direction of displacement of the pusher element and extending above the rollers in order to guide the skis of the passengers.

21. System according to claim 8 further comprising a launching track on which passengers being launched stand which includes a rigid chassis having an articulated mounting on the ground so as to be capable of variable inclination and control means for varying said inclination.

22. System according to claim 21 comprising an order indicating means for the passengers having a removable stop arm arranged at the track entrance and synchronised with the movement of the pusher element for permitting selective access by passengers to the track.

23. System according to claim 22 wherein said indicating means includes signal lights arranged upstream of the stop arm and synchronised with the movement thereof.

24. System according to claim 21 wherein the launching track is articulated about a horizontal axis located approximately at the track entrance, said control means comprising a controllable jack mounted between said track and a supporting structure.

25. System according to claim 8 in which the pusher element comprises a propelling structure coupled to the driving device by a telescopic arm.

26. System according to claim 8 wherein the prime mover comprises an electric motor and control means for said motor including means for detecting the position of the carrying structure.

27. System according to claim 26 further including safety means for automatically stopping the driving device in the event of a passenger fall.

* * * * *